US008794945B2

(12) United States Patent
Forgy et al.

(10) Patent No.: US 8,794,945 B2
(45) Date of Patent: Aug. 5, 2014

(54) ROTARY PUMP OR MOTOR WITH ORBITAL PISTON ASPIRATION

(76) Inventors: Fritz Forgy, Mountain View, CA (US); John Novak, Jr., Campbell, CA (US)

( * ) Notice: Subject to any disclaimer, the term of this patent is extended or adjusted under 35 U.S.C. 154(b) by 954 days.

(21) Appl. No.: 12/421,955

(22) Filed: Apr. 10, 2009

(65) Prior Publication Data

US 2009/0257898 A1 Oct. 15, 2009

Related U.S. Application Data

(60) Provisional application No. 61/043,836, filed on Apr. 10, 2008.

(51) Int. Cl.
*F04C 15/06* (2006.01)
*F01C 21/06* (2006.01)

(52) U.S. Cl.
USPC ..... 418/186; 418/100; 418/187; 418/188

(58) Field of Classification Search
USPC ..... 418/100, 191, 183–188
See application file for complete search history.

(56) References Cited

U.S. PATENT DOCUMENTS

| | | | | | |
|---|---|---|---|---|---|
| 709,773 | A * | 9/1902 | Jones | 418/186 |
| 878,327 | A * | 2/1908 | Adams | 418/186 |
| 2,655,112 | A | 6/1952 | White | |
| 2,690,869 | A * | 10/1954 | Brown | 418/191 |
| 2,776,086 | A * | 1/1957 | Selden | 418/196 |
| 2,827,024 | A * | 3/1958 | Arietti | 418/186 |
| 3,459,275 | A * | 8/1969 | Seyfarth et al. | 418/181 |
| 4,464,102 | A | 8/1984 | Eiermann | |
| 4,699,101 | A * | 10/1987 | Dettwiler | 418/191 |
| 4,940,394 | A * | 7/1990 | Gibbons | 418/134 |
| 7,201,134 | B2 * | 4/2007 | Guest et al. | 418/191 |
| 2003/0124010 | A1 * | 7/2003 | Henderson | 418/2 |

FOREIGN PATENT DOCUMENTS

| | | | | |
|---|---|---|---|---|
| WO | WO 2007031092 | A1 * | 3/2007 | F04C 2/08 |

* cited by examiner

*Primary Examiner* — Mary A Davis
(74) *Attorney, Agent, or Firm* — Sandra P. Thompson, Esq.; Buchalter Nemer, APLC

(57) ABSTRACT

Rotary components are described that include a housing comprising a rotor having a rotor working face and a gate having a gate working face and a pocket; at least one vane, wherein the vane is coupled to the rotor; at least one wiper coupled to the vane; a plurality of endplates coupled to the housing, wherein at least one of the endplates is a float plate; an intake chamber; and an outlet chamber. In addition, methods of aspirating a working medium by utilizing the rotary component having at least one float plate includes pulling the working medium into the intake chamber, depositing the working medium into a working chamber that is located between the intake chamber and the outlet chamber; maintaining the working medium in a stationary position until the vane sweeps around toward the outlet chamber; accumulating the working medium into the outlet channel of the outlet chamber; and centrifugally ejecting the working medium into the outlet chamber and out of the system.

17 Claims, 8 Drawing Sheets

ROTARY PUMP OR MOTOR WITH ORBITAL PISTON ASPIRATION

This application is a United States Utility Application that claims priority to U.S. Provisional Application Ser. No. 61/043,836 filed on Apr. 10, 2008, which is incorporated herein in its entirety by reference.

FIELD OF THE SUBJECT MATTER

The field of the subject matter comprises rotary components, including piston type pumps, compressors and motors, their methods of production and uses thereof.

BACKGROUND

Rotary piston pumps and motors of the circumferential piston type have potential advantages over reciprocating pumps due to the rotary motion of working members and near-continuous intake and outlet cycles. Potential advantages include: a compact size for a given output, decreased pulsation, reduced noise and vibration, relatively simple construction, and others. However, it has been impossible to achieve this potential in practice due to inefficient aspiration; poor heat dissipation; and problematic sealing and durability resulting in the need for extreme accuracy in machining and fitting the various parts. A review of the prior art illustrates these disadvantages.

U.S. Pat. No. 2,655,112 discloses a "Rotary Pump or Motor" whereby working fluid enters radially through the housing wall into a rotating interior chamber. The chambers rotation creates significant centrifugal forces that push fluid back out of the device and makes the required transit towards an inboard passage and thus into the working chamber inefficient. Within the working chamber itself, the rotor and gate have a conical profile that meshes when the two features are fully engaged. While this profile forms a seal at full engagement, it creates a significant gap at the points where the vane engages and disengages from the gate, thus decreasing efficiency. Another disadvantage of this device is that no device, apparatus or method are provided for cooling the interior rotating components. Gas compression applications generate significant heat which will transfer to the device, which in turn will transfer back to newly incoming gas media and potentially overheating the device. The sealing scheme on this device is also problematic. Eight seals are employed on the outer circumference of the working rotor plus an additional two on the vane tip. Increased frictional drag from ten large seals will erode much of the efficiency gained by eliminating leaks. Additionally, these seal points will wear and eventually fail, shortening the devices practical life. Another disadvantage of this device is accurately locating the two working components. They are located via bearings mounted on shafts, keyed into the rotors. The bearings are then journalled into an end plate, which is then attached via fasteners machined into the housing, which represents at least six points where machining and assembly accuracy are critical. From a practical standpoint, manufacturing this device would be difficult and costly.

U.S. Pat. No. 4,464,102 discloses some improvements to the above device but still with significant disadvantages. First, because of the outlet vents location on the housing wall, the vane will have no pumping action from engagement of the outlet vent until passing through the gate (roughly 25% of its rotation). During this period, no work will be accomplished and previously worked media will flow back into the working chamber. A check valve or other type valve isn't disclosed, but even with such a device installed, there will be backflow from any dead space between such a valve and the working chamber. Another disadvantage arises from the lack of an outlet port on the fore vane face. The intake port on the aft vane face efficiently deposits working fluid, but this fluid must then be forced around the circumference of the cylinder to the outlet passage thus creating turbulence, heat and inefficiency. Perhaps the more significant disadvantage is sealing between intake and outlet sides of the working surfaces. There is no active seal between the vane tip and the housing wall or the gate surface wall. Precise machining and assembly may reduce leakage but the costs to achieve this are prohibitive, not fully effective, and won't compensate for wear. Additionally sealing the tops and bottoms of the two rotor member from the endplates of the housing requires high precision and does not allow for wear. This device would be limited to low pressure applications. Another disadvantage, especially for a compressor or other gas application where heated media compounds inefficiency, is cooling of the rotor intake channel. Incoming working fluid will reside for some period in the rotor body and will carry some of the heat into the pump cylinder. Ideally this interior cavity would be actively cooled with minimal rise in working fluid temperature.

Ideally, a contemplated pump and/or motor should achieve the following goals: a) improve aspiration of worked media such that obstructions or hindrances are reduced and centrifugal force enhances flow rate, b) increase volumetric efficiency of the rotary stroke such that substantially the full volume of the cylinder cavity is utilized and converted to worked media each stroke, c) add active cooling to internal components in order to improve heat dissipation of the device and minimize ambient heating of working media, d) reduce design requirements for accuracy in manufacturing and assembly such that costs can be reduced and robustness added for improved durability, and e) accomplish the above goals while maintaining or improving advantages inherent in rotary cylinder devices relative to reciprocating pumps or motors, namely; compact size relative to work performed; efficiency (improved mass flow rate relative to work input); and quiet, low vibration, pulse-free operation. In addition, pumps and/or motors of simple construction should be provided that includes ease of assembly, low parts count, and manufacturability of components such that it can be produced at a competitive cost.

SUMMARY OF THE SUBJECT MATTER

Rotary components are described that include a housing comprising a rotor having a rotor working face and a gate having a gate working face and a pocket; at least one vane, wherein the vane is coupled to the rotor; at least one wiper coupled to the vane; a plurality of endplates coupled to the housing, wherein at least one of the endplates is a float plate; an intake chamber; and an outlet chamber.

In addition, methods of aspirating a working medium by utilizing the rotary component having at least one float plate includes pulling the working medium into the intake chamber, depositing the working medium into a working chamber that is located between the intake chamber and the outlet chamber; maintaining the working medium in a stationary position until the vane sweeps around toward the outlet chamber; accumulating the working medium into the outlet channel of the outlet chamber; and centrifugally ejecting the working medium into the outlet chamber and out of the system.

DETAILED DESCRIPTION

Figure 1:
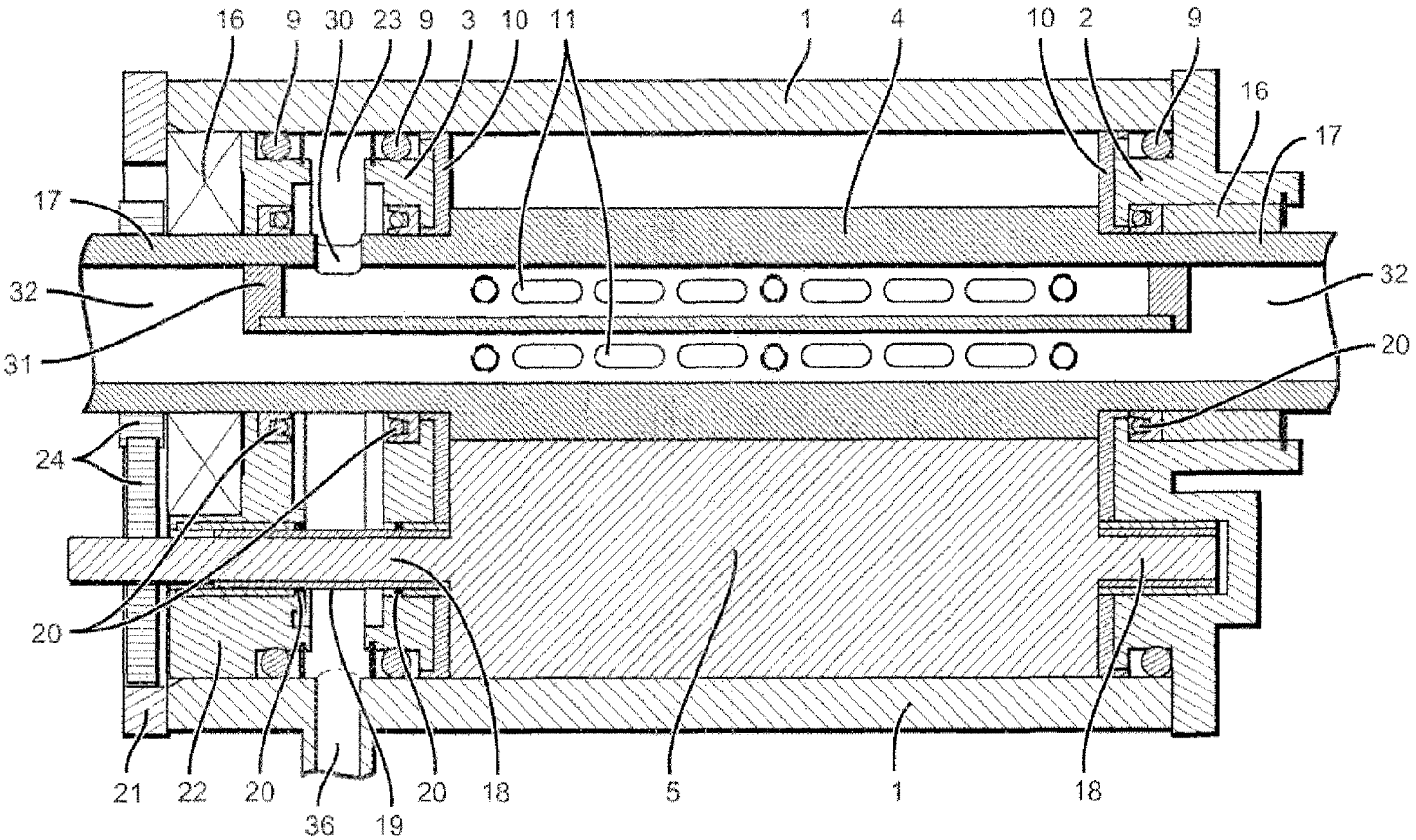
FIG. 1 shows sectional side view of mechanism with working members rotated 90 degrees beyond full engagement.

Surprisingly, contemplated rotary components, such as pumps and/or motors have been developed and are described herein that achieve the following goals: a) improve aspiration of worked media such that rotation of the main rotor assembly enhances mass flow rate, and that obstructions or hindrances to this flow are reduced, b) increase volumetric efficiency of the rotary stroke such that substantially the full volume of the cylinder cavity is utilized and converted to worked media each stroke, c) add active cooling to internal components in order to improve heat dissipation of the device and minimize ambient heating of working media, d) reduce design requirements for accuracy in manufacturing, and assembly such that costs can be reduced and robustness added for improved durability, and e) accomplish the above goals while maintaining or improving advantages inherent in rotary cylinder devices relative to reciprocating pumps or motors, namely; compact size relative to work performed; efficiency (improved mass flow rate relative to work input); and quiet, low vibration, pulse-free operation. In addition, contemplated pumps and/or motors of simple construction are provided that include ease of assembly, low parts count, and manufacturability of components such that it can be produced at a competitive cost.

Contemplated rotary components, such as rotary piston pumps, compressors, and/or motors of the circumferential piston type comprise endplates including bearings, seals, and rotor and gate shafts located radially by the pump housing inner wall either directly or indirectly; ports for aspiration on either side of rotor vane; aspiration channels running along axis of rotor shaft; internal ambient cooling via rotor shaft; and axial float of working members such that there is active compensation for wear. As used herein, the terms "medium" or "media" refer to the material, such as a liquid, a gas, a gel or any other suitable material, that transitions through the rotary component. As used herein, the phrase "working media" or "working medium" means that medium or media that is being utilized with the rotary component.

Rotary components are described that include a housing comprising a rotor having a rotor working face and a gate having a gate working face and a pocket; at least one vane, wherein the vane is coupled to the rotor; at least one wiper coupled to the vane; a plurality of endplates coupled to the housing, wherein at least one of the endplates is a float plate; an intake chamber; and an outlet chamber.

In addition, methods of aspirating a working medium by utilizing the rotary component having at least one float plate includes pulling the working medium into the intake chamber, depositing the working medium into a working chamber that is located between the intake chamber and the outlet chamber; maintaining the working medium in a stationary position until the vane sweeps around toward the outlet chamber; accumulating the working medium into the outlet channel of the outlet chamber; and centrifugally ejecting the working medium into the outlet chamber and out of the system.

Contemplated embodiments are shown in FIGS. 14 and comprise a mechanism accommodated in a sealed space formed by a housing 1 with two endplates consisting of a fixed plate 2 and float plate 3 in sealing contact with the housing inner wall 12. A wear pad 10, of any suitable low friction material (PTFE, polyamide-imide, acetal, or other plastic, ceramic, graphite, or other low friction high wear material) is on the working surface of fixed plate 2 and float plate 3. A wall seal 9 (o-ring or any other common type seal) forming a "figure-8" shape produces an additional seal between housing inner wall 12 and the fixed plate 2 and float plate 3.

The mechanism comprises a rotor 4 and a gate 5 with working faces 6 and 7 respectively, mounted such that rotor working face 6 and gate working face 7 have a slight interference fit and the rotor 4 has an outer portion of its body composed of a compliant skin 8, such as polyurethane, rubber, silicone or any suitable compliant material. The gate 5 either comprises or is coated by a low friction material such as a polyamide-imide-based material, a polyetheretherketone-based material, an acetal-based material, PTFE, or any suitable plastic-based material, a ceramic-based material, a graphite-based material, or other low friction high wear material. Counter balance 33 is installed on rotor 4 and/or gate 5 as required; A vane 13 is attached to the rotor 4 through any common device, apparatus or method, or may be integral to the rotor 4 in the case of an extrusion or common machined component. A wiper 14 is located by the vane 13 such that it forms a contact seal with the housing inner wall 12. This contact may be centrifugally driven or may be assisted by a spring 15 of any common compression form (leaf or wound spring, o-ring, rubber insert, or other compressible material, device or apparatus). Contemplated rotary components comprise at least one wiper that is in contact with the inner wall. In some embodiments, as mentioned, the at least one wiper forms a contact seal with the inner wall. Contemplated contact seals are formed by a centrifugal force, a physical force or a combination thereof. As mentioned, in some embodiments, the physical force is applied through the use of a spring.

Location of the mechanism within housing 1 is radially controlled by any common type bearings 16 which mount internally to rotor shaft 17 and gate shaft 18 directly or by a device, method or apparatus of a bushing 19. Bearings mount externally to the housing inner wall 12 either directly (as illustrated with the rotor shaft 17 on the seal plate 22 side of the pump—FIG. 1), or indirectly via bushings for which the fixed plate 2 and float plate 3 may functionally serve (as illustrated with the rotor shaft 17 on the fixed plate 2 side of the pump—FIG. 1). The mechanism is axially located on one end by the wear pad 10 and fixed plate 2 which is fastened to the housing 1. The other end is axially located by the wear pad 10 and float plate 3. A third endplate comprised of a seal plate 22 is further outboard of the float plate 3, the two of which, together with the housing 1 form an outlet chamber 23. The seal plate 22 is axially located by the bearing 16 located by an endcap 21. The interior of the outlet chamber 23 may have noise abatement devices (baffles, absorptive coatings, glass pack, etc.) depending on media worked and application requirements.

The rotor shaft 17 or gate shaft 18 is connected with a prime mover by any common device, apparatus or method. The working face of rotor 6 and of gate 7 are of like pitch and diameter and may have an external mechanism to maintain timing (gear, belt, pulley or other common timing device).

An intake channel 25 and outlet channel 26 run down the axis of the rotor shaft 17 and are separated by a divider 27. The divider can be integral to the rotor shaft 17 in the case of an extrusion, casting, or if the channels are machined. Or it can be a separate component inserted into the rotor shaft 17. An outlet vent 30 radially exits the outlet channel 26 into the outlet chamber 23. Plugs 31 seal off the outlet channel 26 at the termination of the divider. The rotor shaft 17 may extend beyond the divider termination in which case the intake channel 25 expands to the full channel bore 32. The vane 13 has ports 28 on intake and outlet sides which commute with the intake channel 25 and outlet channel 26 via apertures 11 in rotor 4. Between the rotor 4 and vane 13 is an optional check valve 29 (of any common valve type; reed, ball, poppet, etc.) that forms a directional seal against the base of the vane 13 as required. The housing 1 contains an outlet 36 venting the outlet chamber 23.

Contemplated pumps and/or motors can be characterized by their method of aspiration, design robustness and manufacturability, and cooling, along with the components that ensure that these methods are implemented. Efficient aspiration is initiated with the channel bore 32, where the working media is pulled towards the working chamber along or near the centerline of rotor 4 with little resistance given the large passage and central location. The worked media enters the intake channel 25 and is deposited into the working chamber assisted by centrifugal force and the large ports 28. While resident in the working chamber the worked media is relatively stationary until the vane has swept back around to the outlet side thus little friction, turbulence, or heating is generated. The outlet ports 28 on the vane 13 accumulates the media back into outlet channel 26 and centrifugally ejects it into the outlet chamber 23 and out of the system through the outlet 36. Aspiration is through large unobstructed ports, follows a short working path, and is assisted by centrifugal force. The primary result is efficient flow with significantly decreased power consumption for a given mass flow rate. Secondary advantages include heat dissipation due to decreased frictional turbulence and long resident time against the rotor shaft 17 and housing inner wall 12, and decreased noise due to the internal position of intake apertures and outlet vent 30. Contemplated rotary components, as disclosed herein, may also comprise at least one cooling component, cooling arrangement or combination thereof. In some embodiments, the at least one cooling component comprises a fan.

Figure 5A:
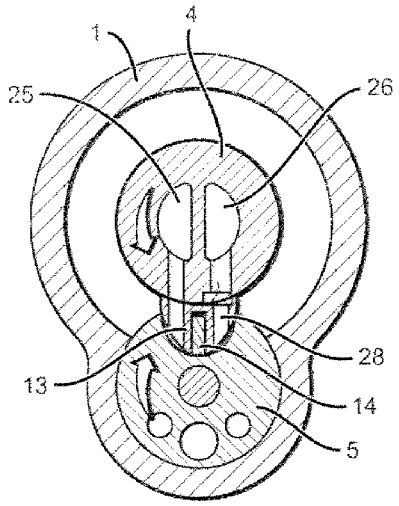
FIGS. 5A-5D show sectional end views of the mechanism in different states of rotation.
Figure 5B:
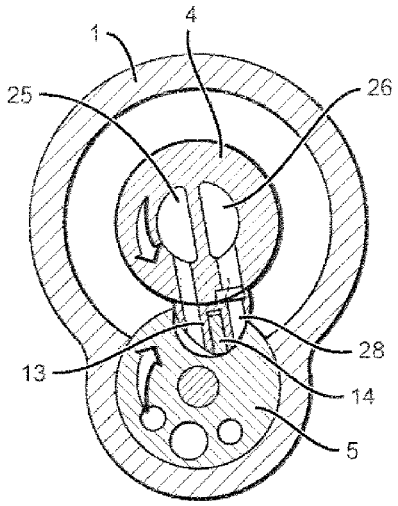
Figure 5C:
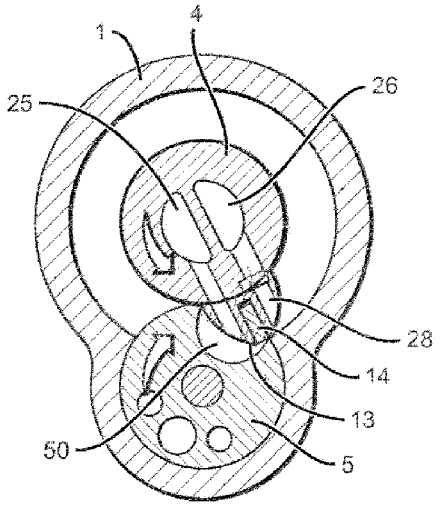
Figure 5D:
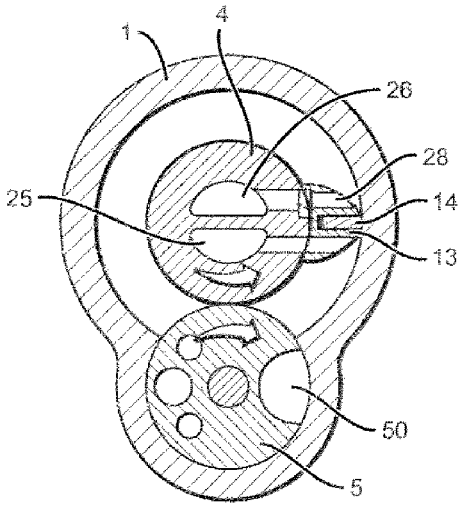

The second aspect of efficient aspiration is avoiding volumetric losses in the pump stroke due to leakage or back flow. Positioning of the intake and outlet ports 28 on the vane face 13, combined with active contact sealing of wiper 14 and wear pads 10 provides a leak free stroke while in contact with the housing inner wall 12. Upon engagement with the pocket detail 50 of gate 5, wiper 14 continues providing an efficient seal due to the epicycloidal shape of the pocket. Additionally, the location of the intake and outlet ports 28 on vane face 13 are located towards the vane tip such that the leading and/or trailing edges of the pocket detail 50 of gate 5 prevent intake and outlet ports 28 from commuting directly. The result of these two sealing methods is that there is substantially no exchange between high and low pressure sides of the vane during full rotation. Seal leakage could negate some of this efficiency as in practice wear will occur within the pump cylinder on the wiper 14, skin 8 and wearplates 10, however each of these components has a robust wear compensating design. In the event that inadvertent leakage does occur particularly at the pocket/vane interface, the check valve 29 is an optional component available to minimize backflow. Note that the check valve will change locations to the exterior surface of the vane ports 28 on the intake side if the pump application is a vacuum. FIGS. 5A-5D illustrate a contemplated rotor stroke while FIG. 5B illustrates approximate dead-space at maximum closure provided by the twin cycloid profile of 0.2%.

Robustness and manufacturability are improved in contemplated embodiments, in that the working mechanism is not fixed axially and will compensate for wear. In initial assembly the rotor 4 and gate 5 are pushed up against the wear pad 10 on fixed plate 2. On the other end, float plate 3 with an additional wear pad 10 pushes against rotor 4 and gate 5 such that a contact seal is obtained at top and bottom of the working chamber and little or no leakage occurs. In practice, any small leaks are actually decreased as the wear pads 10 set in. This is a result of wear absorption by float plate 3. In operation, worked media will enter the outlet chamber 23. Seal plate 22 ensures that the pressure of this material is not lost to atmosphere, and a pressure differential is created as outlet chamber 23 will have a higher pressure than the average pressure in the working chamber. This differential creates continuous pressure on the outside face of the sealed float plate 3 and thus absorbs inevitable wear on the wear plates 10. The only significant tolerance issue that threatens persistent leaks is the lengths of the rotor 4 and gate 5 not being substantially equal, which is a relatively easy dimension to control. The advantages of this design are significant in that performance, durability, and manufacturability are all improved.

Robustness and manufacturability are also improved in contemplated embodiments, in that the rotor 4 and gate 5 are radially located directly by the housing inner wall 12. The assembly of wear plate 10, fixed plate 2 and bearings 16 are pressed into the housing inner wall 12 and locate the rotor shaft 17 and gate shaft 18 relative to the same housing inner wall 12. The demands for precision machining and assembly seen in the prior art are substantially eliminated. Radial location is also robust in that should any of the above assemblies degrade due to wear, there is a backup. For the gate rotor 5 relative to the housing inner wall 12 if the bearing assembly is loose the gate rotor 5 is of a bearing type material (polyamide-imide or equivalent) and can ride against the housing inner wall 12. If the rotor 4 is loose relative to the housing inner wall 12 the wiper will compensate, and if the gate 5 relative to the rotor 4 is loose then the compliant skin 8 will compensate.

Figure 4:
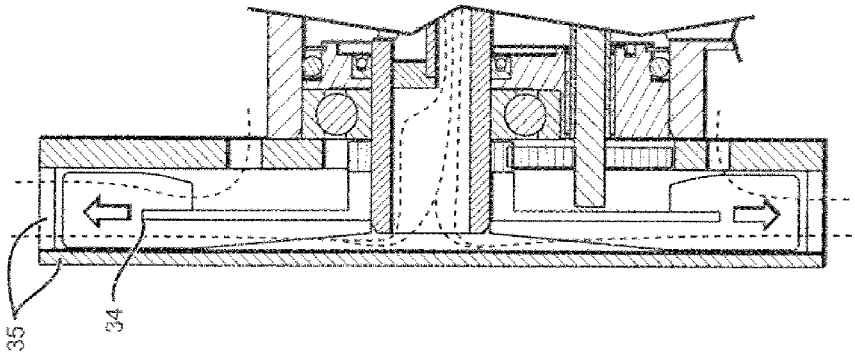
FIG. 4 shows sectional side view detail of cooling fan elements.

Contemplated pumps and/or motors dissipate heat on external and internal working surfaces. Intake channel 25 commutes to the full channel bore 32 at both ends of the rotor 4. FIG. 4 shows a fan 34 with a fan housing 35 such that in operation, the fan will move ambient air into the full channel bore 32 and through the intake channel 25 and then vent this cooling air outside the pump. Any common type fan configuration (radial, axial, etc.) can be used when paired with an appropriate housing, and the fans action may be push or pull. The advantages of this device from a heat dissipation standpoint are: a) the addition of coolant flow over the interior of rotor 4 will cool the device and allow continuous operation without excessive heat buildup, b) the lower temperatures will improve wear characteristics and allow operation without external lubricant, and c) the increased velocity of ambient air within intake channel 25 will provide cooler air to the working chamber thus further improving heat characteristics and resulting in more efficient compression or pumping.

Figure 2:
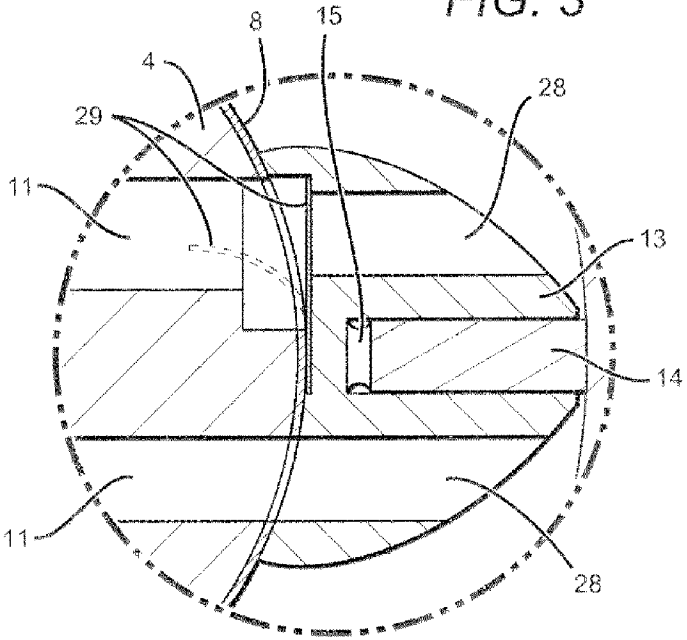
FIG. 2 shows sectional end view of mechanism with working members rotated 90 degrees beyond full engagement.
Figure 3:
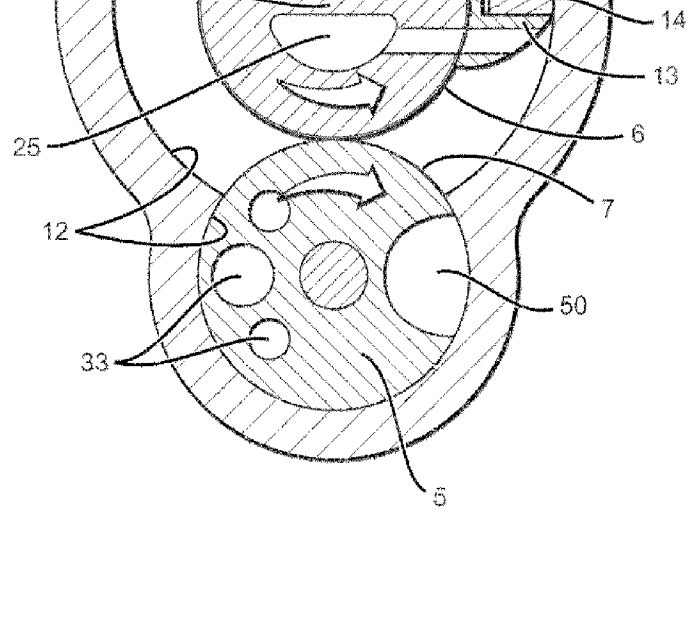
FIG. 3 shows sectional end view detail of the vane assembly.
Figure 6B:
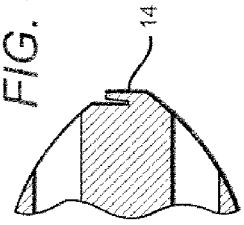
FIG. 6A-6C shows an additional contemplated embodiment.
Figure 6C:
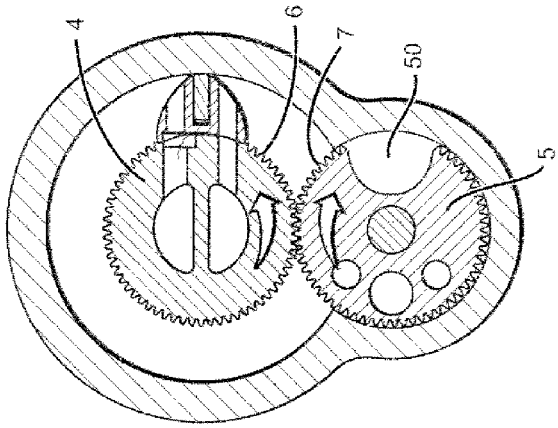
Figure 6A:
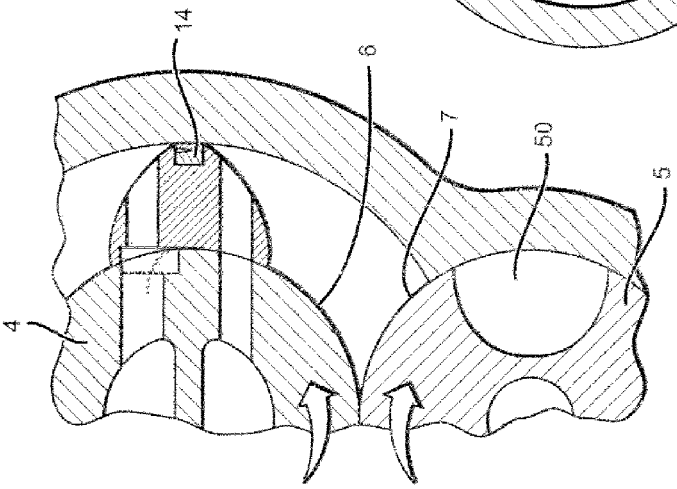

FIG. 6A shows an additional contemplated embodiment whereby rotor 4 and gate 5 have been changed to a contact fit rather than interference, and the compliant skin (skin 8, FIG. 2) has been removed from rotor 4. In this embodiment the working surfaces 6 and 7 provide sufficient sealing without a compliant material, and frictional drag is reduced. FIG. 6A shows an additional embodiment whereby wiper 14 is of a lip type rather than a vane.

FIG. 6B illustrates a third additional embodiment whereby wiper 14 forms a lip type seal composed of the same material as the vane 13 body. These additional embodiments illustrate that any common type seal may be used as the wiper 14.

FIG. 6C shows an additional embodiment whereby the working surface 6 and 7 on rotor 4 and gate 5 respectively have been changed to gear teeth of like pitch and diameter such that the intermeshing teeth block excessive leaks and serve as timing gears. Gears 24, FIG. 1 could be removed in this embodiment.

Figure 7:
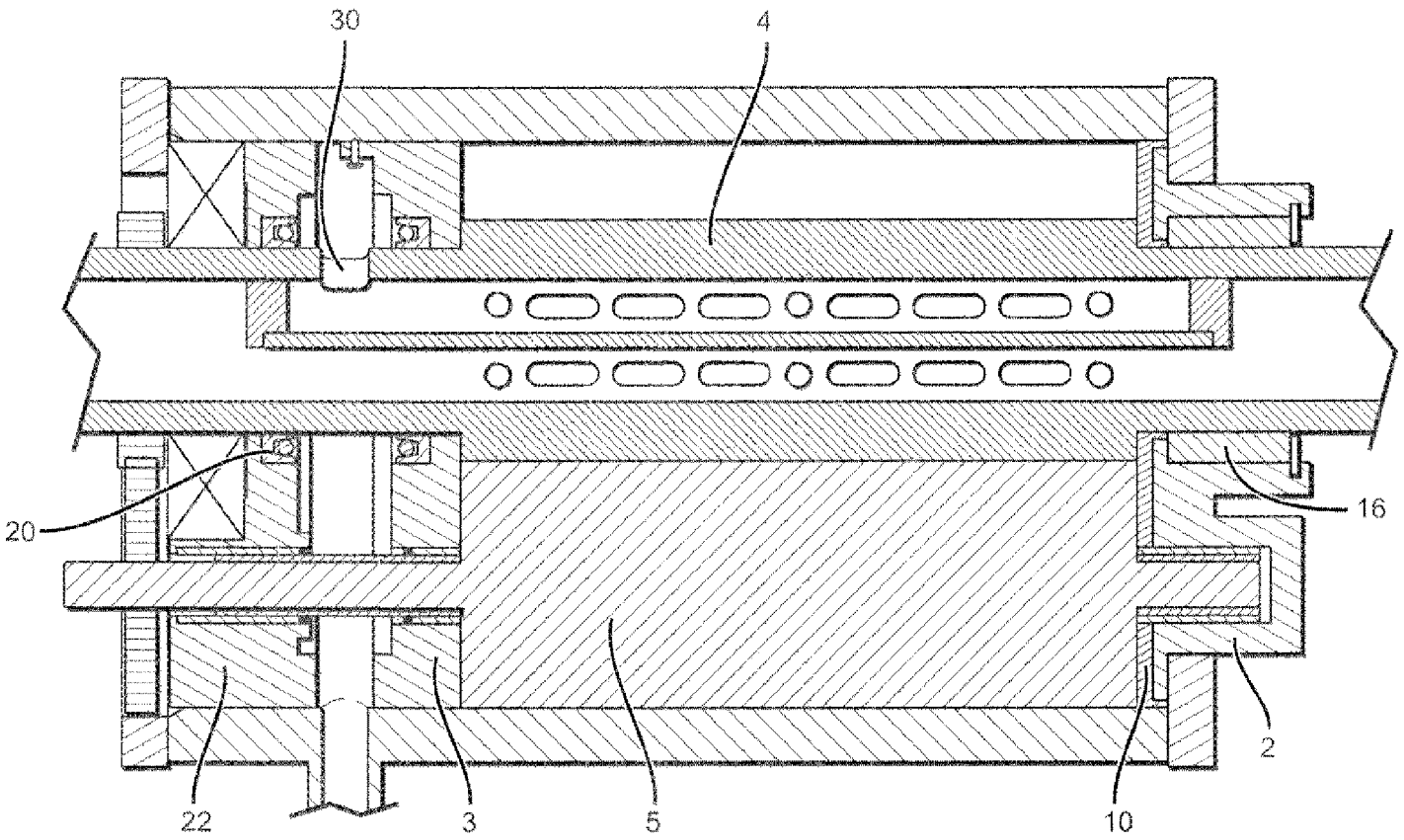
FIG. 7 shows an additional contemplated embodiment.

FIG. 7 shows an additional contemplated embodiment whereby float plate 3 has no wear pad 10, but rather comes into direct contact with rotor 4 and gate 5. In this embodiment float plate 3 is either constructed of a self lubricating material (plastic, graphite, ceramic, or similar), or of any common material whereby the worked media provides lubrication. This embodiment could apply to fixed plate 2 as well. FIG. 7 also shows an additional embodiment where float plate 3 is fixed axially to the housing wall in assembly such that in operation it does not float. This embodiment is appropriate were leaks or wear are sufficiently slight as to not warrant floating action. Any common method of fastening or adhesion could be used. FIG. 7 also shows another embodiment whereby wall seal 9 is eliminated and float plate 3 provides a sufficient seal. This embodiment could apply to seal plate 22 as well. Finally, FIG. 7 shows an additional embodiment whereby the seal 20 is eliminated from the fixed plate 2 end and the wear pad 10 and bearing 16 form a contact seal with the rotor 4 and gate 5 at the shoulder formed by intersection with the rotor shaft 17 and gate shaft 18 respectively. This additional embodiment may be applied separately to the rotor 4 or gate 5 at either or both of the ends.

Figure 8:
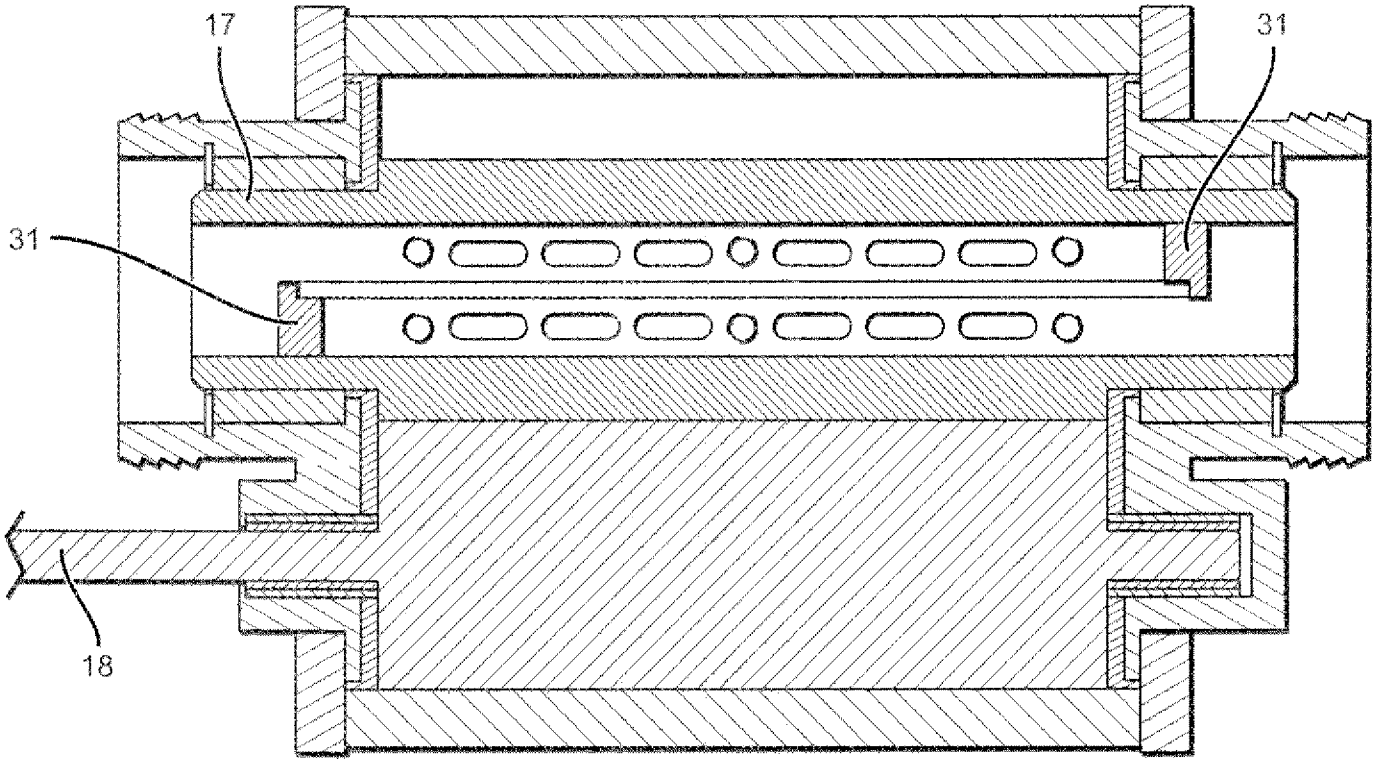
FIG. 8 shows an additional contemplated embodiment.

FIG. 8 shows a contemplated embodiment whereby the outlet vent 30 and seal plate 22 (FIG. 1) is removed such that there is no outlet chamber, and the outlet plugs 31 have been switched to alternate sides, and intake and outlet is ported through fittings commuting directly to either end of the rotor shaft 17 such that the device is of a simpler embodiment appropriate for either liquid or low pressure gas pumping or as a motor (driven by pressurized gas or liquid). This device utilizes gate shaft 18 for drive coupling.

Figure 9:
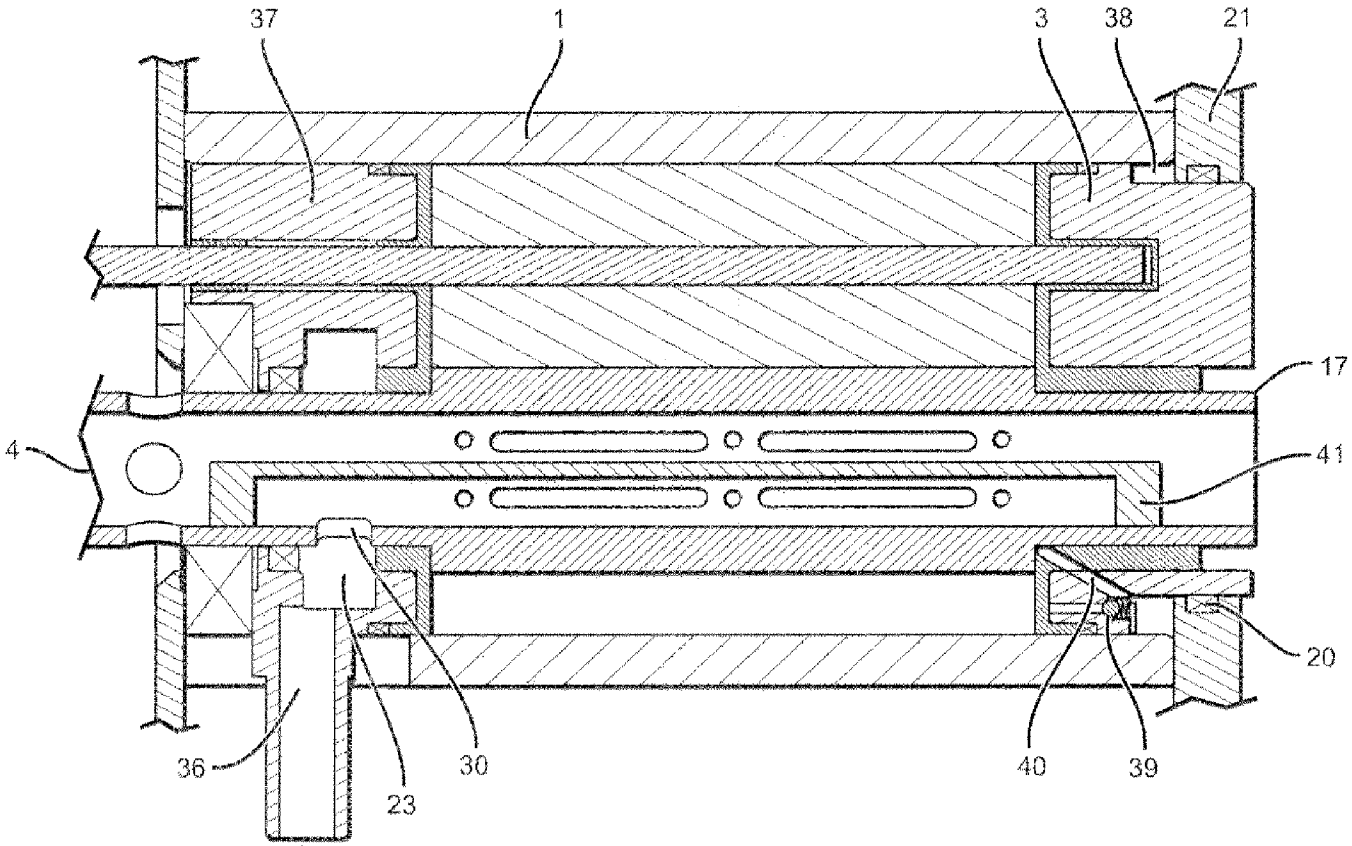
FIG. 9 shows sectional side view of an additional embodiment of the mechanism with working members rotated 90 degrees beyond full engagement.

FIG. 9 shows an additional embodiment where a fixed plate, seal plate, outlet chamber, and outlet (fixed plate 2, seal plate 22, outlet chamber 23, and outlet 36 as shown in FIG. 1) have been incorporated into a single, functionally equivalent, exhaust plate 37 while the float plate 3 is located on the opposite end of the device such that: a) exhaust plate 37 remains axially fixed relative to the housing 1 and provides an outlet chamber 23 and an outlet 36 for pumped media to exit the device, b) a pressure compensation chamber 38 is provided between the float plate 3 and the endcap 21, c) worked media enters the pressure compensation chamber 38 through either a check valve 39 and/or a shoulder valve 40, d) check valve 39 allows worked media in the working chamber to enter the pressure compensation chamber 38 while preventing backflow by any common check valve type (ball, poppet, reed, etc.), e) shoulder valve 40 allows worked media in the working chamber to enter the pressure compensation chamber 38 while preventing backflow by the location of its orifice on the working chamber side being located on the top (or shoulder) of the rotor 4 such that pressure within the pressure compensation chamber 38 may equal or exceed pressure in the working chamber, and f) a seal 20 of any common type (o-ring, lip-seal, etc.) is provided between the float plate 3 and endcap 21 such that the pressure compensation chamber 38 is sealed while allowing axial movement of the float plate 3.

FIG. 9 also shows an additional embodiment whereby said outlet plugs (outlet plug 31 as shown in FIG. 1) is replaced by a divider insert 41 located within the hollow rotor shaft 17 such that a sealed cavity is formed, allowing worked media to exit the working chamber and pass to the outlet vent 30.

Figure 10:
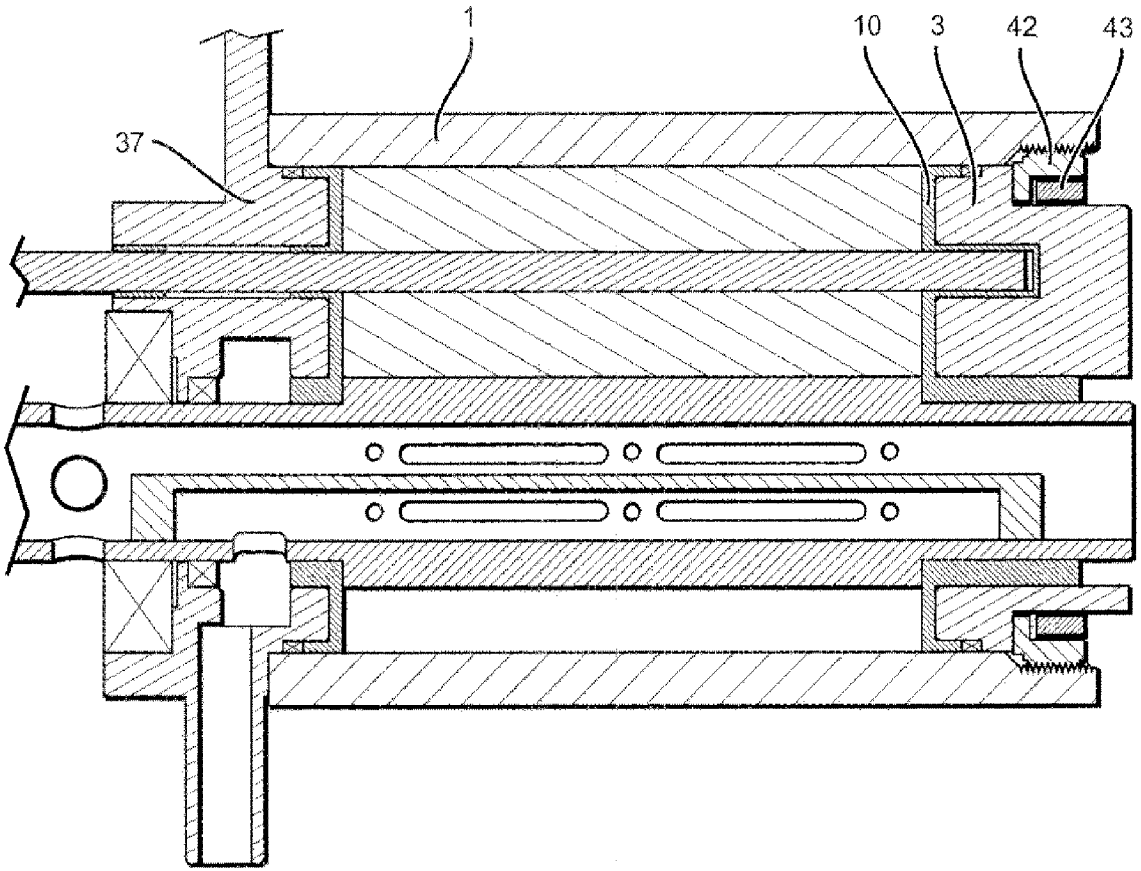
FIG. 10 shows sectional side view of an additional embodiment of the mechanism with working members rotated 90 degrees beyond full engagement.

FIG. 10 shows an additional embodiment whereby an endcap (endcap 21 as shown in FIG. 9) has been replaced by a screw ring 42 and a spring 43 such that screw ring 42 axially locates float plate 3 within radial confines of housing 1 such that float plate 3 and wear pad 10 form a sealed end to working chamber, and spring 43 is formed from a constant-force spring, torsion spring, or other common compressive device and attached such that a tightening force is applied to screw ring 42 in order to compensate for axial wear within working chamber. FIG. 10 also shows another embodiment whereby exhaust plate 37 is fixed axially directly to housing 1 while still located radially by housing inner wall 12 such that endcap 21 as shown in FIG. 1 can be eliminated.

In a contemplated embodiment, a rotary pump or motor comprises: two substantially parallel, round, tangential shafts of substantially like pitch and diameter that counter-rotate co-periodically; shaft 1 defining a rotor having a single vane projection such that the rotor has a greater overall diameter than shaft 2 defining a gate having a single pocket indentation; the rotor and the gate shafts are located within a housing whose inner wall is formed by two intersecting cylinders such that a figure-eight shape is formed comprising a larger and smaller cavity. The rotor is designed into the larger cavity of the housing such that the apex of its vane forms a contact seal with the housing wall in rotation; the gate fits into the smaller cavity with no more clearance than required to allow free rotation along its axis. It is contemplated that the rotor and gate shafts are timed by any common device, apparatus or method, such that the vane and pocket details mesh in rotation; the rotor or the gate may be connected by any common device, apparatus or method to a prime mover.

A contemplated housing can be sealed by endplates at either end of the rotor and the gate; the endplates having a sealing periphery substantially the inverse of the inner wall of the housing and located such that the inner wall controls the radial position of the endplates; the endplates have two openings suitable for passage or capture of the rotor and the gate such that the rotor and gate are controlled in radial position and the working chamber is sealed by the endplates. The endplates can be sufficiently close to the top and bottom working surfaces of the rotor and the gate as to substantially eliminate leakage over the surfaces; a wear pad of any low friction material may be added to working surface of the endplates or the endplates may be constructed of material itself suitable to the application. Contemplated endplates may comprise components, such as bearings, shafts, seals, bushings, the wear pads, and structural elements suitable to support or constrain the components.

In contemplated embodiments, an intake port and an outlet port are located on opposing faces of the vane feature of the rotor; the ports commute to an intake and an outlet channel respectively; the channels run substantially parallel to the axis of the rotor; whereby a working chamber of torroidal shape is formed, with the working elements of the rotor and the gate being radially located directly or indirectly by the inner wall of the housing; with the vane of the rotor operating as piston, and as traveling intake and outlet ports, and as intake and outlet channels, while the gate forms an abutment that temporarily allows passage of the vane through its pocket detail.

In some contemplated embodiments, the rotor extends substantially through the device on both ends; a cooling channel is provided along the axis of the rotor and is substantially open and unobstructed to ambient; wherein the cooling channel may occupy same passage as the intake channel or may be a newly provided channel; whereby a coolant passage passes through the assembly's core.

In another embodiment, the rotor and the gate may be in an axially floating position relative to the housing; one of the endplates is secured to housing in a predetermined location while second of the endplates is secured to housing after installation of, and in an axial location relative to, the rotor and the gate; whereby component and assembly tolerances are eased while the mechanisms fit is ensured.

In yet another embodiment of a rotary pump or motor a) an assembly is formed by a first of the endplates axially fixed proximate one end of the housing with the rotor and the gate abutting; a second the endplate is installed abutting opposite side of the rotor and the gate but is not axially fixed; a third the endplate is fixed in axial position proximate end of the housing on side opposite of the first the endplate such that the third endplate is outboard of second endplate; b) an outlet chamber is thus formed on one end of the device between, the second and the third endplates, and inner wall of the housing; and c) an outlet plug is applied to both ends of the outlet channel; an outlet vent is provided on the rotor proximate the outlet chamber such that the channel vents through the outlet vent into the outlet chamber; whereby outlet pressure within the outlet chamber may compensate for assembly fit and axial wear as it works to expand the volume of the outlet chamber.

In another embodiment, a wiper element of any low friction material (PTFE, graphite, polyamide-imide or other suitable plastic, ceramic, metal, or similar) may be provided on the vane proximate the housing wall; wherein the wiper is provided with a method, device or apparatus for continuous outward extension towards, and contact with, the housing wall; wherein the method, apparatus or device includes centrifugal force, compressive forces within the wiper itself, or any common spring type; the approach angle of extension towards the housing wall may be perpendicular plus or minus ninety degrees; whereby the wiper may maintain a continuous seal with the housing wall and pocket detail of the gate.

In some embodiments, the pocket or pocket indentation of the gate has a shape substantially like an epicycloid overlaying itself, with a circumferential offset opening substantially equal to the width of the wiper; whereby the gate may accommodate passage of, while maintaining contact with and minimizing reciprocation of, the wiper.

In some embodiments, the vane has a shape substantially like an epicycloid overlaying itself, with a circumferential arc substantially equal to the width of the pocket indentation; whereby the vane may substantially fill the volume of the pocket without having interference in rotation. Contemplated vane ports may also be of a predetermined size and may be located at a predetermined offset from the centerline of the vane whereby at full engagement of the vane with the pocket, the ports are confined and substantially sealed by the pocket.

In other embodiments, a gate may be manufactured from or have an outer coating comprised of, a low friction self lubricating material (such as polyamide-imide, polyetheretherketones, acetal, PTFE or any similar plastic, ceramic, graphite, or other low friction high wear material) whereby the gate may rotate in the housing without requiring lubrication or creating excess heat.

Contemplated check valves may be added to the vane; wherein the check valve comprises reed, ball, poppet, or other common types; whereby inadvertent backflow is prevented.

In other embodiments, a contemplated housing may modified by removing a predetermined section of the wall of the housing proximate the gate and opposite the rotor whereby sufficient material remains to maintain a seal while cooling of the surface of the gate is improved.

In another embodiment, a contemplated working face of the rotor comprises a compliant material such as polyurethane, rubber, silicone or similar; the rotor and the gate are located such that a predetermined interference engagement between the two occurs; whereby the compliant face provides a seal between the roller and the gate.

Another contemplated embodiment is disclosed where the rotor and the gate have geared working faces of like diameter, pitch and pressure angle whereby external timing can be eliminated and gear faces act substantially as a seal.

In some embodiments, components, such as a rotor, a gate or housing are manufactured from a single piece of material such as an extrusion whereby different capacity devices can be manufactured from the same raw material simply by changing length, thus reducing cost and material requirements.

From the description above, a number of advantages of the rotary pump or motor with orbital piston aspiration, become evident: a) aspiration of the worked media is improved in that obstructions and hindrances including centrifugal force are substantially removed and the rotating action of the main rotor assembly enhances mass flow rate, b) volumetric efficiency approaching 100 percent is obtained such that substantially the full volume of the cylinder cavity is converted to worked media each stroke, c) active heat dissipation is provided including internal cavities of work surfaces such that the device runs cooler and pumped media does not heat at intake, d) manufacturability is significantly improved by a design that is robust in its assembly and wear characteristics such that extraordinary tolerances of manufactured parts can be eased or eliminated, while component fit will remain tight after prolonged wear, and e) this device accomplishes the above while excelling at the advantages inherent to rotary cylinder devices relative to reciprocating pumps or motors, namely; compact size relative to work performed; efficiency (improved mass flow rate relative to work input); and quiet, low vibration, pulse-free operation. Further contemplated embodiments comprise simple construction including ease of assembly, low parts count, and readily manufacturable components such that it can be produced at a competitive cost.

Although the description above contains many specifics, these should not be construed as limiting the scope of the subject matter but as merely providing illustrations of some of the contemplated embodiments. For example: the wiper is shown with no radial offset from the axis of the rotor. In certain applications, it may be advantageous to offset its angle of attack; the intake and outlet ports as well as the intake and outlet apertures on the rotor are shown as straight-cut slots. Dependant on the worked media it may be advantageous to enlarge, decrease, bevel or radius these ports to tune those things that can be tuned, such as flow.

Thus, specific embodiments and applications of rotary pumps, motors and related apparatus have been disclosed. It should be apparent, however, to those skilled in the art that many more modifications besides those already described are possible without departing from the inventive concepts herein. The inventive subject matter, therefore, is not to be restricted except in the spirit of the disclosure herein. Moreover, in interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

We claim:

1. A rotary component, comprising:

a housing comprising an inner wall, a rotor having a rotor working face and a gate having a gate working face and a pocket;

at least one vane, wherein the at least one vane is coupled to the rotor, and wherein the at least one vane comprises a tip, an intake port and an outlet port;

at least one wiper inserted into a groove at the tip of the at least one vane with a spring so that the wiper is in continuous contact with the housing inner wall or the gate and located between the intake port and the outlet port;

a plurality of endplates coupled to the housing, wherein at least one of the endplates is a float plate;

an intake chamber;

an outlet chamber, and at least one cooling component comprises a fan that moves ambient air into the intake chamber.

2. The rotary component of claim 1, wherein the rotary component comprises a pump.

3. The rotary component of claim 1, wherein the plurality of endplates further comprises a fixed plate, a seal plate, the float plate or a combination thereof.

4. The rotary component of claim 3, wherein the plurality of endplates further comprise at least one wear pad.

5. The rotary component of claim 1, wherein the rotor comprises an outer portion composed of a compliant skin.

6. The rotary component of claim 5, wherein the compliant skin comprise polyurethane, rubber, or silicone.

7. The rotary component of claim 1, wherein the gate comprises a low friction material.

8. The rotary component of claim 7, wherein the low friction material comprises a polyamide material, a polyimide material, a polyether ketone material, an acetal material, PTFE, a graphite-based material or a combination thereof.

9. The rotary component of claim 1, wherein the rotor, gate or combination thereof further comprise a counter balance.

10. The rotary component of claim 1, wherein the continuous contact is formed by a combination of a centrifugal force and a physical force.

11. The rotary component of claim 10, wherein the physical force is applied through the use of the spring.

12. The rotary component of claim 1, wherein a plurality of bearings are coupled to a shaft on the rotor, a shaft on the gate or a combination thereof.

13. The rotary component of claim 1, wherein the intake chamber comprises the intake port coupled to an intake channel.

14. The rotary component of claim 1, wherein the outlet chamber comprises the outlet port coupled to an outlet channel.

15. The rotary component of claim 1, wherein the outlet chamber comprises at least one noise abatement device.

16. The rotary component of claim 15, wherein the at least one noise abatement device comprises a plurality of baffles, absorptive coatings, glass pack or a combination thereof.

17. The rotary component of claim 1, wherein the at least one vane is designed to mate with the pocket.

* * * * *